US007669755B2

(12) United States Patent
Smalley

(10) Patent No.: US 7,669,755 B2
(45) Date of Patent: Mar. 2, 2010

(54) CARTON WITH HINGED LID

(75) Inventor: Brian Leslie Smalley, Downend (GB)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/221,476

(22) Filed: Aug. 1, 2008

(65) Prior Publication Data

US 2008/0314905 A1 Dec. 25, 2008

Related U.S. Application Data

(63) Continuation of application No. 11/573,521, filed as application No. PCT/US2005/028050 on Aug. 5, 2005.

(30) Foreign Application Priority Data

Aug. 10, 2004 (GB) ..... 0417746.5

(51) Int. Cl.
*B65D 17/28* (2006.01)
*B65D 5/54* (2006.01)

(52) U.S. Cl. ..... 229/225; 229/145; 229/226; 229/227

(58) Field of Classification Search ..... 229/225, 229/226, 227, 905, 224, 228
See application file for complete search history.

(56) References Cited

U.S. PATENT DOCUMENTS

| | | | | |
|---|---|---|---|---|
| 2,835,594 | A | 5/1958 | Felt et al. | |
| 3,131,851 | A | 5/1964 | Pace | |
| 3,206,103 | A * | 9/1965 | Bixler | 229/227 |
| 3,310,222 | A * | 3/1967 | Buttery | 229/226 |
| 3,310,223 | A * | 3/1967 | Buttery | 229/227 |
| 3,409,205 | A * | 11/1968 | Meyers | 229/227 |
| 3,410,476 | A * | 11/1968 | Buttery | 229/208 |
| 3,524,581 | A * | 8/1970 | Buttery | 229/226 |
| 3,734,390 | A | 5/1973 | Buttery et al. | |
| 3,981,434 | A | 9/1976 | Ramich | |
| 4,046,313 | A | 9/1977 | Perry | |
| 4,111,297 | A | 9/1978 | Paulin | |
| 4,289,240 | A * | 9/1981 | Mueller | 229/226 |
| 4,669,614 | A | 6/1987 | Froom | |
| 4,749,086 | A | 6/1988 | Donohie | |
| 4,757,902 | A | 7/1988 | Hutchinson et al. | |
| 4,907,698 | A | 3/1990 | Konrad et al. | |
| 5,097,958 | A | 3/1992 | Josephs et al. | |
| 5,484,102 | A | 1/1996 | DeMay | |
| 6,834,793 | B2 * | 12/2004 | Sutherland | 229/227 |

FOREIGN PATENT DOCUMENTS

| | | |
|---|---|---|
| DE | 1 586 447 | 4/1970 |
| GB | 2 321 237 A | 7/1998 |

(Continued)

*Primary Examiner*—Gary E Elkins
(74) *Attorney, Agent, or Firm*—Womble Carlyle Sandridge & Rice, PLLC

(57) ABSTRACT

A blank capable of being formed into a carton to define a volume for receiving articles is provided. The carton includes a lid formed hingedly connected at a fold at one end and including a line of weakening to facilitate separation of the lid from the main body of the carton. The volume can accommodate introduction of ice or other substance with and/or between the articles and the lid can be hinged between open and closed positions.

15 Claims, 7 Drawing Sheets

FOREIGN PATENT DOCUMENTS

| | | |
|---|---|---|
| JP | S52-039054 | 3/1952 |
| JP | S52-096178 | 8/1977 |
| JP | S54-079106 | 6/1979 |
| JP | S56-28096 | 7/1981 |
| JP | H06-87221 | 12/1994 |
| JP | H7-28016 | 5/1995 |
| JP | H08-113246 | 5/1996 |
| JP | 2002-87427 | 3/2002 |
| WO | WO 92/06896 | 4/1992 |

* cited by examiner 40
31
17
16
20
31
12
12
12

CARTON WITH HINGED LID

CROSS-REFERENCE TO RELATED APPLICATION

This application is a continuation of application Ser. No. 11/573,521, filed Feb. 9, 2007, which is the National Stage of International Application PCT/US2005/028050, filed on Aug. 5, 2005, which claims the benefit of Great Britain application serial no. GB 0417746.5, filed on Aug. 10, 2004, the contents of all documents hereby being incorporated by reference, in their entirety.

BACKGROUND OF THE INVENTION

The present invention relates to cartons having hinged lids. Such cartons are particularly but not exclusively suited for cans such as beverage cans, the opening lid enabling the cans to be removed and enabling ice to be easily inserted into the carton in the spaces between the cans.

According to the present invention there is provided a carton comprising a main body defining therein a volume for receiving articles and a lid which is hingedly connected by means of a fold to the main body to selectively open and close the volume, a marginal portion of the lid adjacent a free edge opposite the fold being secured to the main body and a line of weakening being provided to facilitate separation of the remaining portion of the lid from the main body to enable the carton to be opened.

The carton has substantially rectangular faces, comprising a base, a top, a front, a rear and oppositely disposed sides and also can have each side comprising a plurality of partial side panels secured relative to each other. In some embodiments the partial side panels at each side comprise base, top, front and rear partial side panels hingedly connected to the respective main panels.

The lid can incorporate at least the forward part of the top panel of the carton and can have a partial front panel which extends downwardly from a front edge of the top panel. The partial front panel generally overlaps an upper area of the main front panel of the main body and providing the marginal portion, which is adhered to the main body. Conveniently a line of adhesive is provided across the carton between the front panel of the main body and the marginal portion of the partial front panel of the lid, the line of weakening being positioned just above the line of adhesive.

The hinge lid between the lid and the main body can constitute the junction between the top and rear sides of the carton. In some embodiments the hinge fold incorporates weakening means to facilitate complete removal of the lid.

In some arrangements, the lid incorporates upper parts of the sides of the carton, the upper parts being defined in the sides by further lines of weakening. With these embodiments, the further line of weakening can extend downwardly at an angle from the hinge fold between the lid and the main body and then substantially horizontally such that it is generally in alignment with the line of weakening in the partial front panel of the lid. Sections of the front and rear partial side panels can project above the further lines of weakening.

Usually each of the upper parts incorporates the top portion of the top partial side panel, adjacent the hinge with the top panel and in addition each of the upper parts also incorporates an upper corner portion of the front partial side panel, spaced from the hinge with the front panel.

The articles are cans arranged to sit with their bottom end on the base panel of the carton.

BRIEF DESCRIPTION OF THE DRAWINGS

Embodiments of the present invention will now be described in more detail. The description refers to the following drawings in which.

DETAILED DESCRIPTION

Figure 1:
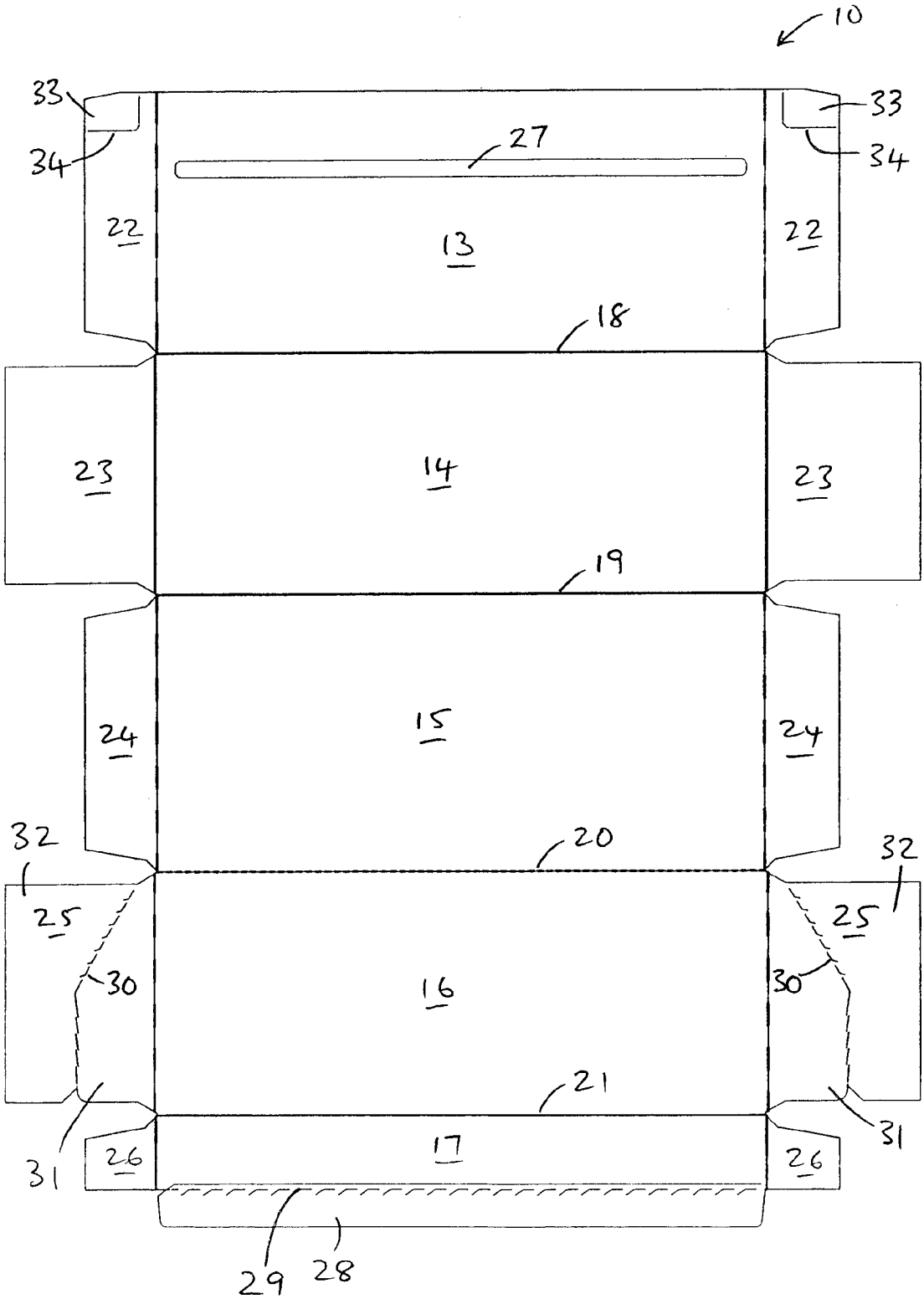
FIG. 1 is a view of the blank for producing a carton according to the present invention.
Figure 2:
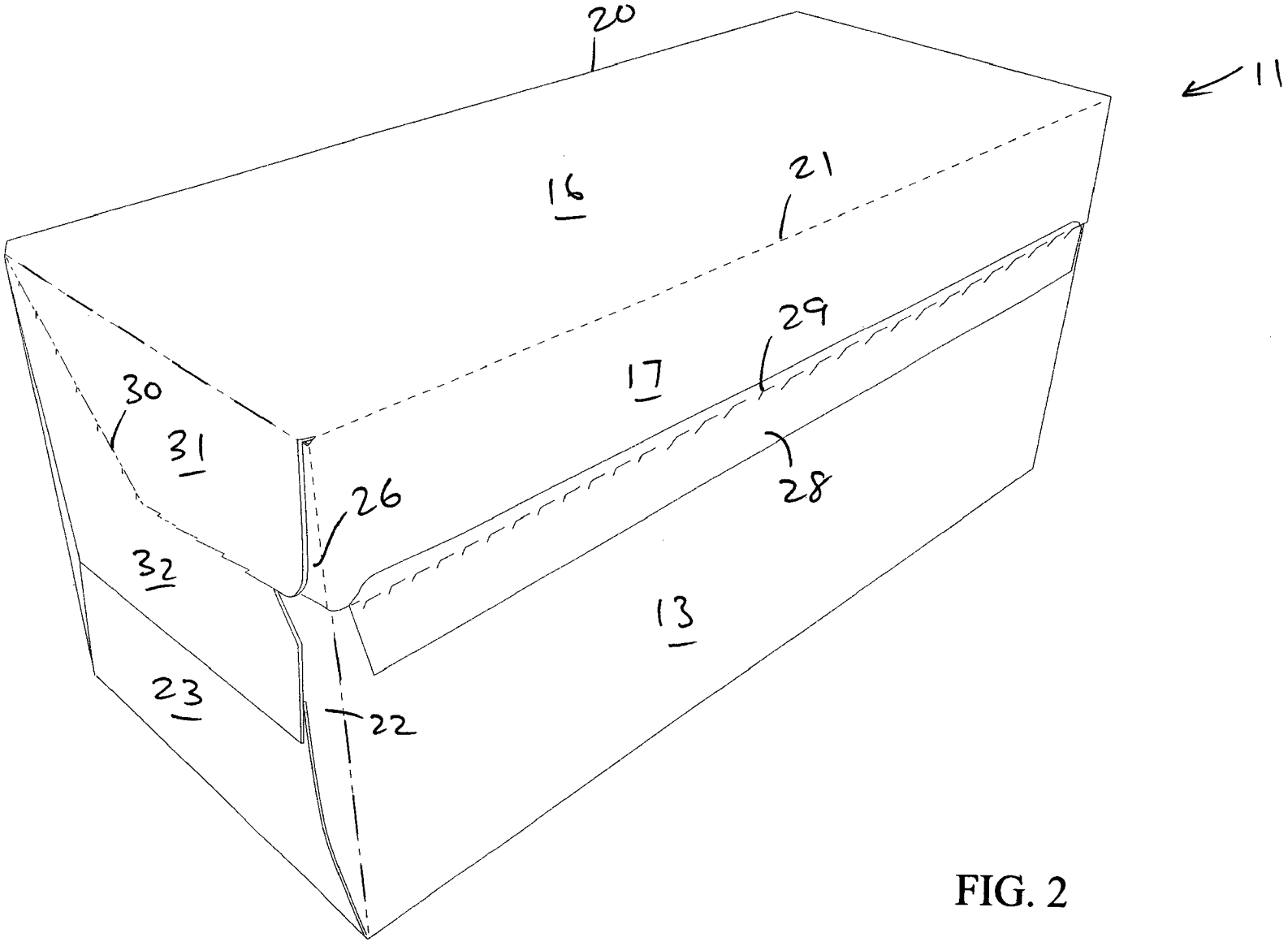
FIG. 2 is a perspective view of the assembled carton.

In FIGS. 1 to 6, a paperboard blank 10 for producing a carton 11 is shown. In use, the carton 11 contains in this example a number of beverage cans 12. In the particular embodiment shown ten cans 12 are provided in two rows of five cans, but other numbers and arrangements can be accommodated by simple modification.

The blank 10 comprises a main front panel 13, a base 14, a rear panel 15, a top panel 16 and a partial front panel 17, all hingedly connected together by a series of parallel folds 18, 19, 20 and 21. Each of the panels 13 to 17 is hingedly connected at each end to a partial side panel 22 to 26 respectively.

Across the main front panel 13 a glue line 27 is indicated such that when the panels 13 to 16 are folded into a rectangular sleeve, the partial front panel 17 overlaps the part of the main panel 13 remote from the fold 18 and a marginal portion 28 of the partial front panel 17 is secured to the glue line 27. The marginal portion 28 of the partial panel 17 is defined from the remainder by means of a line of weakness 29, such as perforations or aligned, spaced cuts.

In each top partial side panel 25 a further line of weakening 30 is provided to define upper and lower portions 31, 32, for example using perforations or aligned, spaced cuts. The line extends at an angle from the area of the fold 20 and then proceeds generally horizontally to the free edge. In addition, the topmost corner portion 33 of the front partial side panel 22 is defined by a further line of weakness 34, such as perforations or aligned, spaced cuts, which line of weakness 34 is spaced from the hinge with the front panel 13.

Figure 3:
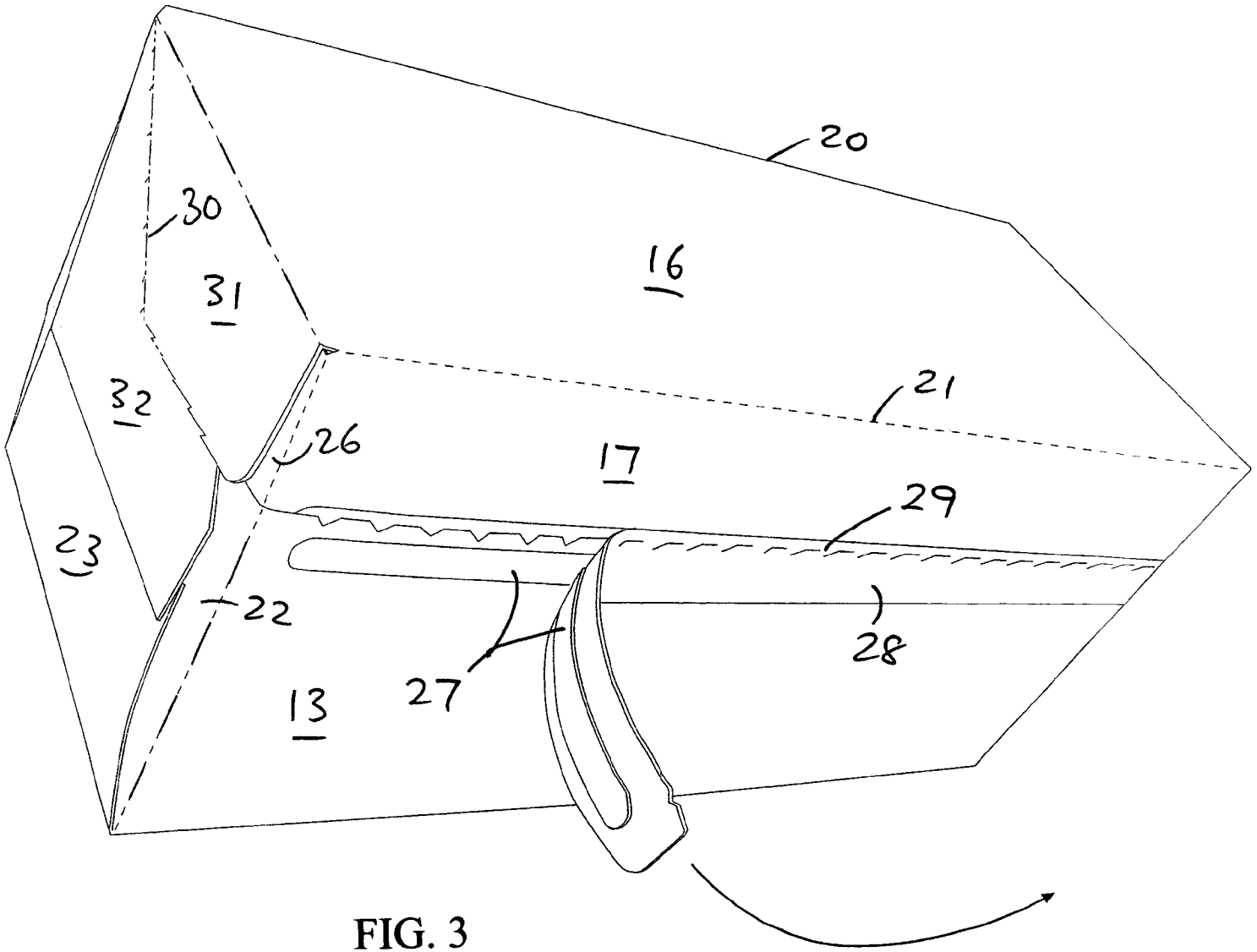
FIG. 3 is a perspective view of the FIG. 2 carton being opened.

After the main panels have been formed as a sleeve about the cans 12 (the sleeve can either be formed around the cans or the cans can be inserted into the formed sleeve), the partial side panels 22 to 26 can be folded in and secured relative to each other. This results in the fully enclosed, erected carton shown in FIG. 2. In order to gain access to the cans 12, the marginal portion 28 of the partial front panel 17 is pulled from one end as indicated in FIG. 3. This causes the marginal portion 28 to separate along the line of weakening 29 and to overcome the adhesive connection of the glue line 27. Once the marginal portion 28 is fully removed, the remainder of the partial front panel 17 together with the top panel 16 and the upper portions 31 of the partial side panels 25 can be hinged about the fold 20, thus severing the further lines of weakness 30, 34. The carton 10 effectively now has a lid 40 and a main body 50, the lid 40 being openable and closable relative to the main body 50 by hinging about the fold 20 as shown in FIGS.

Figure 4:
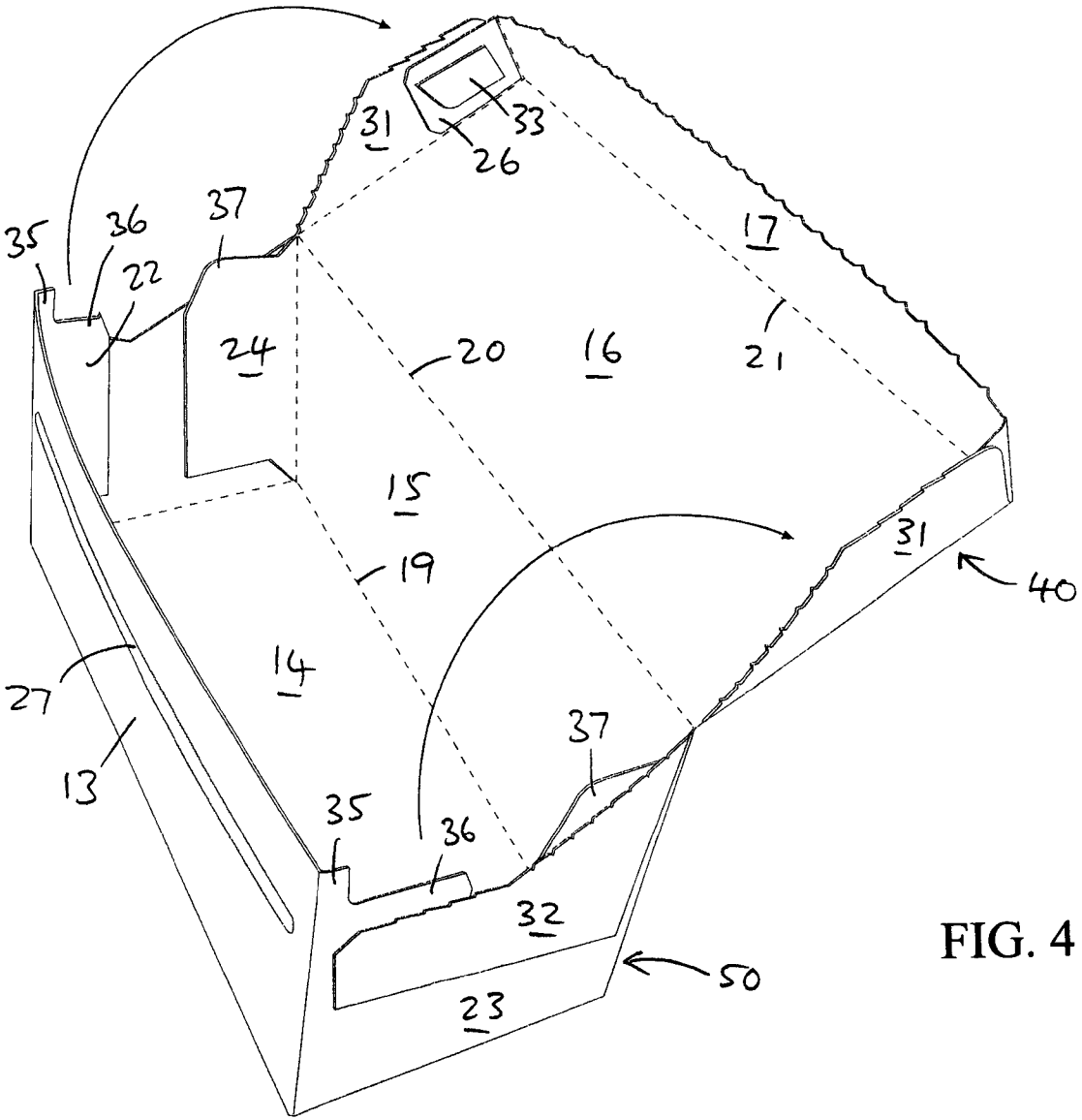
FIG. 4 is a perspective view of the FIG. 3 carton fully opened.

4 and 5 (in FIG. 4 the cans have been omitted to show more clearly the internal construction of the carton 11).

Figure 5:
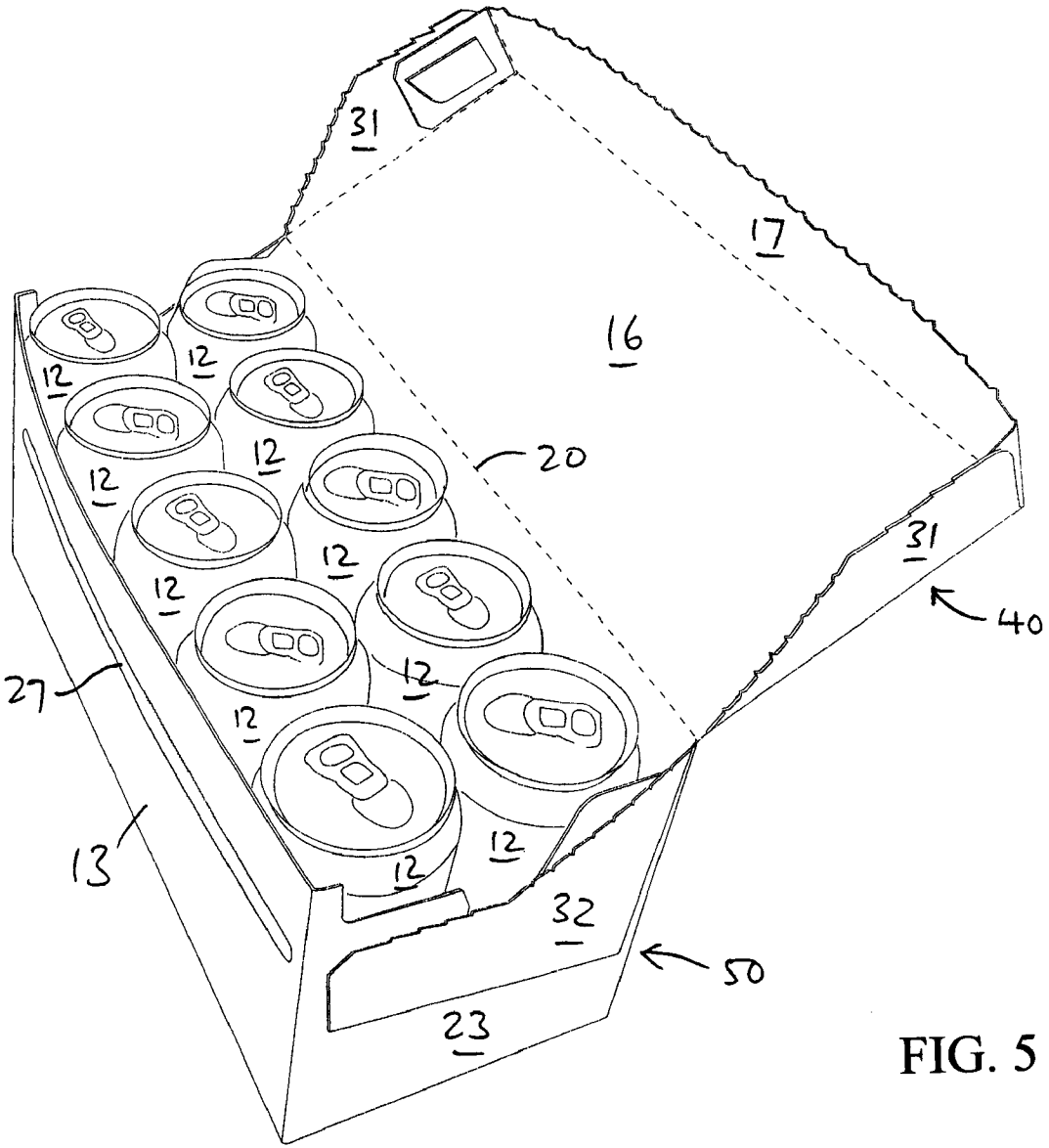
FIG. 5 is a perspective view of the FIG. 4 carton with all articles removed.
Figure 6:
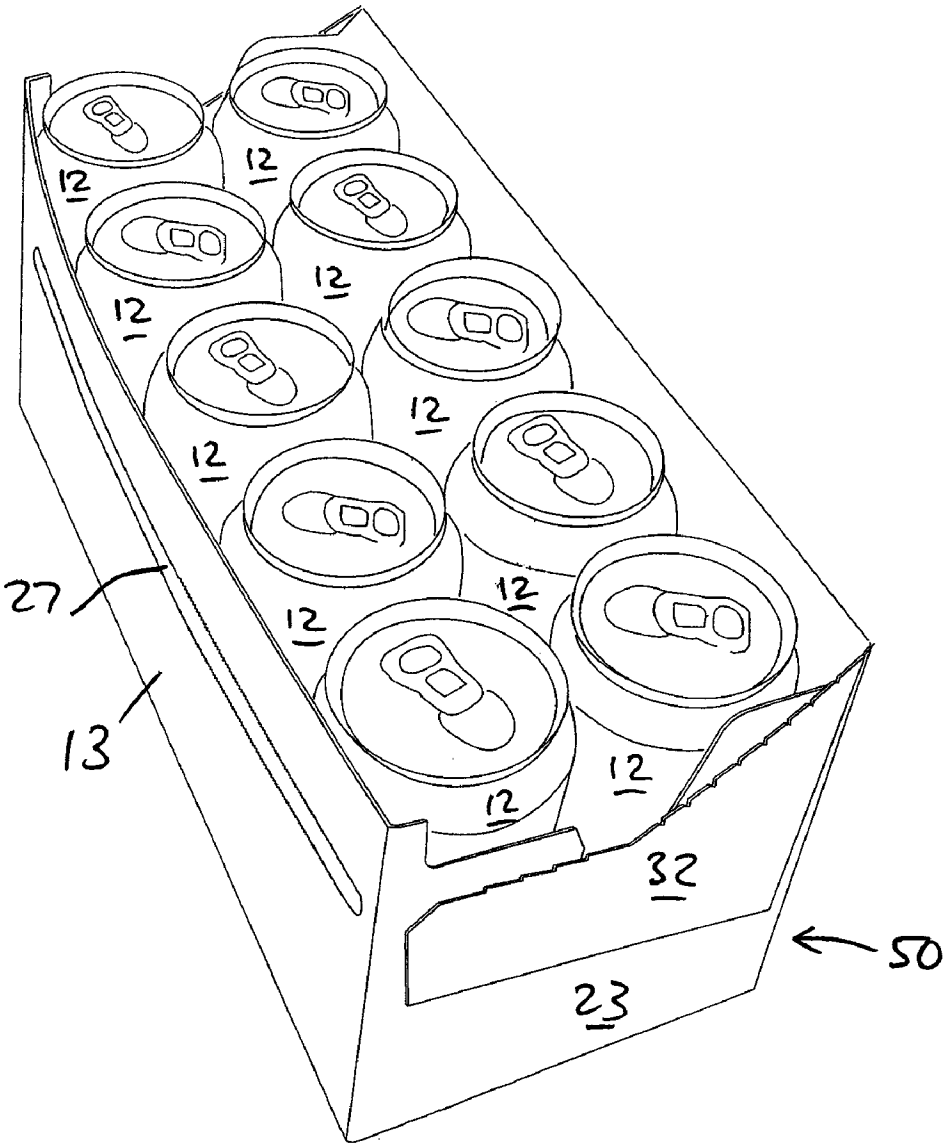
FIG. 6 is a perspective view of the FIG. 4 carton with the lid fully removed.

Once the carton 11 has been opened as shown in FIG. 5, cans 12 can be removed or ice can be added to the main body 50 of the carton, and thus to the spaces between the cans 12, to cool the cans 12. The lid 40 can then be closed again until a can 12 is to be removed or more ice added. The lid 40 can also be fully removed from the main body by tearing along the fold 20, which may also incorporate weakening to facilitate complete removal.

In the illustrated embodiment, the full height main front panel 13 and the remaining upper portions 35 of the front partial side panels 22 retain and support the front part of the lid 40 when it is closed after initial opening. Also it can be seen that upper sections 36, 37 of the front and rear partial side panels 22, 24 project above the top partial side panels 25 (which are folded and glued last during assembly) and these sections 36, 37 again support the sides of the lid 40 when it is closed after initial opening thus increasing pack integrity after initial opening.

Figure 7:
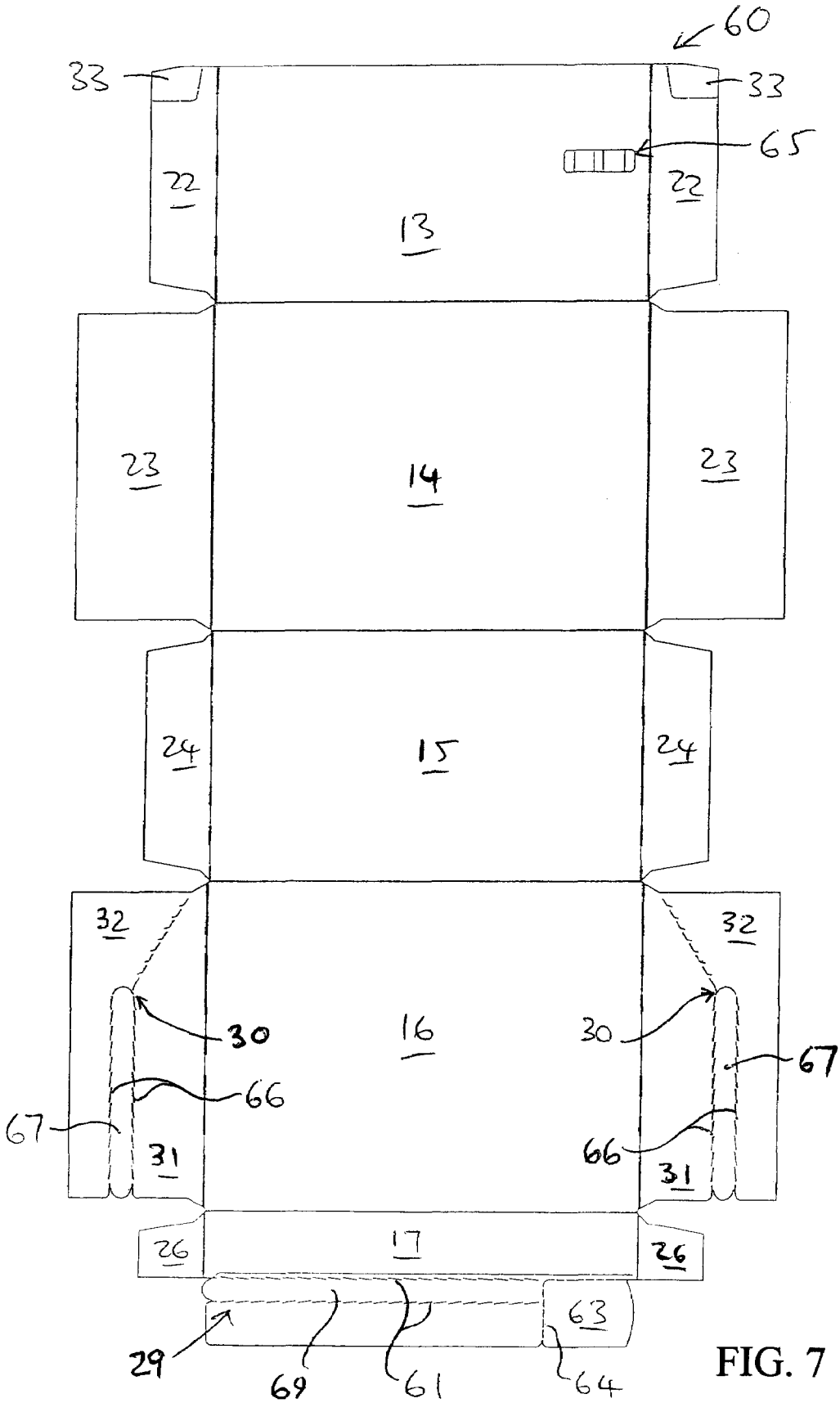
FIG. 7 is a view of an alternative blank for producing another carton according to the present invention.

In the blank 60 shown in FIG. 7, many features are the same as those shown in the blank of FIG. 1 and so they have been given similar reference. The principal differences are in the areas of the lines of weakening 29, 30 between the lid 40 and the main body 50. The front line of weakening 29 in the blank 60 comprises a pair of parallel lines of weakening 61 which are provided above the adhesive joining the marginal portion 28 to the main front panel 13 and which define therebetween a paperboard zipper 62 of a generally known type. Similarly, parts of the side lines of weakening 30 are also constituted by spaced lines of weakening 66 to define side zippers 67. These side zippers 67 could extend the full length of the lines of weakening 30 if desired. At one side of the front lid panel 17 and at one end of the zipper 62 is a detachable portion 63. Ideally, the product bar-code is printed on the detachable portion 63 which can be torn off easily by virtue of the perforated line of weakening 64. Once detached, the portion 63 can be handed to a cashier or checkout operator for scanning, thus avoiding the need to lift and handle a potentially heavy carton. Even after removal of the detachable portion 63, a bar-code 65 or other data means remains on the front of the pack in case the portion 63 has been accidentally detached.

The detachable portion 63 could be any shape or size and could be provided anywhere on the carton, not necessarily at one end of the front zipper 62. The particular location described and shown is however suitable as it is a redundant piece of paperboard when the pack is opened and thus does not interfere with the future opening/closing of the lid. Ideally, the adhesive line 27 does not extend between the detachable portion 63 and the main front panel 13.

Although the hinge of the lid 40 is shown as coinciding with the fold 20 between the rear and top panels 15, 16, it will be appreciated that the hinge could be moved to a crease formed at another suitable location on the carton 11. In one example the hinge could be partway along the top panel 16 or even a short way down the rear panel 15. Obviously suitable modifications would also need to be made to the further lines of weakening. Also, the carton itself need not be rectangular but other shapes could be envisaged.

The invention claimed is:

1. A carton, comprising:

a base;

a rear panel;

a front panel connected to the base;

a first front partial side panel connected to a first end of the front panel, the first front partial side panel being a first generally rectangular panel;

a second front partial side panel connected to a second end of the front panel, the second front partial side panel being a second generally rectangular panel;

a top panel;

a first top partial side panel connected to a first end of the top panel and having a first upper section and a first lower section separated by a line of weakening;

a second top partial side panel connected to a second end of the top panel and having a second upper section and a second lower section separated by a line of weakening;

a partial front panel detachably connected to the front panel;

a first partial front panel partial side panel connected to a first end of the partial front panel; and a second partial front panel partial side panel connected to a second end of the partial front panel, the top panel, at least a portion of the partial front panel and the first and second upper sections of the top partial side panels at least in part define a lid that is pivotable with respect to the rear panel, wherein a portion of the first front partial side panel is adhered to the first partial front panel partial side panel and is defined in part by a line of weakening, the portion of the first front partial side panel comprising an upper corner of the first generally rectangular panel and the line of weakening comprising a first generally L-shaped tear line defining the upper corner of the first generally rectangular panel; and a portion of the second front partial side panel is adhered to the second partial front panel partial side panel and is defined in part by a line of weakening, the portion of the second front partial side panel comprising an upper corner of the second generally rectangular panel and the line of weakening comprising a second generally L-shaped tear line defining the upper corner of the second generally rectangular panel.

2. The carton of claim 1, further comprising:

a first base partial side panel connected to a first end of the base; and a second base partial side panel connected to a second end of the base, wherein the first lower section of the first top partial side panel is adhered to the first base partial side panel.

3. The carton of claim 1, wherein a marginal portion is defined in the partial front panel in part by a line of weakening extending across the partial front panel, the marginal portion being adhered to the front panel.

4. The carton of claim 1, wherein the partial front panel is foldably connected to the top panel.

5. The carton of claim 1 wherein the first generally rectangular panel is foldably connected to the first end of the front panel at a first fold line, the second generally rectangular panel is foldably connected to the second end of the front panel at a second fold line, the first generally L-shaped tear line is spaced apart from the first fold line, and the second generally L-shaped tear line is spaced apart from the second fold line.

6. The carton of claim 1 wherein the lid is pivotable to an open position wherein the upper corner of the first generally rectangular panel is separated from the base portion of the first generally rectangular panel at the first generally L-shaped tear line to create a notch in the base portion of the first front partial side panel, and the upper corner of the second generally rectangular panel is separated from the base portion of the second generally rectangular panel at the second generally L-shaped tear line to create a notch in the base portion of the second front partial side panel.

7. The carton of claim 6 wherein the upper corner of the first generally rectangular panel is separated from the base portion of the first generally rectangular panel without independently folding the upper corner relative to the base portion, and the upper corner of the second generally rectangular panel is separated from the base portion of the second generally rectangular panel without independently folding the upper corner relative to the base portion.

8. A method of opening a carton, comprising:

providing a carton, comprising:

a base;

a rear panel;

a front panel connected to the base;

a first front partial side panel connected to a first end of the front panel, the first front partial side panel being a first generally rectangular shaped panel;

a second front partial side panel connected to a second end of the front panel, the second front partial side panel being a second generally rectangular shaped panel;

a top panel;

a first top partial side panel connected to a first end of the top panel and having a first upper section and a first lower section separated by a line of weakening;

a second top partial side panel connected to a second end of the top panel and having a second upper section and a second lower section separated by a line of weakening;

a partial front panel detachably connected to the front panel;

a first partial front panel partial side panel connected to a first end of the partial front panel; and a second partial front panel partial side panel connected to a second end of the partial front panel;

the first partial front panel partial side panel is adhered to a portion of the first front partial side panel defined in part by a line of weakening, the portion of the first front partial side panel comprising an upper corner of the first generally rectangular panel and the line of weakening comprising a first generally L-shaped tear line defining the upper corner of the first generally rectangular panel and a base portion of the first generally rectangular panel; and the second partial front panel partial side panel is adhered to a portion of the second front partial side panel defined in part by a line of weakening separating a part of the partial front panel from the front panel, the portion of the second front partial side panel comprising an upper corner of the second generally rectangular panel and the line of weakening comprising a second generally L-shaped tear line defining the upper corner of the second generally rectangular panel and a base portion of the second generally rectangular panel;

tearing the first front partial side panel by tearing the first generally L-shaped tear line defining the portion of the first front partial side panel to separate the upper corner of the first generally rectangular panel from the base portion of the first generally rectangular panel;

tearing the second front partial side panel by tearing the second generally L-shaped tear line defining the portion of the second front partial side panel to separate the upper corner of the second generally rectangular panel from the base portion of the second generally rectangular panel;

tearing the first top partial side panel;

tearing the second top partial side panel; and pivoting the top panel with respect to the rear panel to open the carton.

9. The method of claim 8, wherein the carton further comprises:

a first base partial side panel connected to a first end of the base; and a second base partial side panel connected to a second end of the base, wherein the first lower section of the first top partial side panel is adhered to the first base partial side panel.

10. The method of claim 8, further comprising separating a part of the partial front panel from the front panel by separating a marginal portion of the partial front panel from a remainder of the partial front panel.

11. The method of claim 8, wherein:

tearing the first top partial side panel comprises separating the first upper section from the first lower section; and tearing the second top partial side panel comprises separating the second upper section from the second lower section.

12. The method of claim 11, wherein the upper corner portion of the first front partial side panel remains attached to the first partial front partial side panel when the top panel is pivoted open to create a notch in the base portion of the first front partial side panel defined by the first generally L-shaped tear line.

13. The method of claim 8, wherein the top panel, a portion of the partial front panel and the first and second upper sections define in part a lid that is pivotable with respect to the rear panel when the top panel is pivoted open.

14. The method of claim 12 wherein the upper corner of the second front partial side panel remains attached to the second partial front partial side panel when the top panel is pivoted open to create a notch in the base portion of the second front partial side panel defined by the second generally L-shaped tear line.

15. The method of claim 12 wherein the upper corner of the first generally rectangular panel is separated from the base portion of the first generally rectangular panel without independently folding the upper corner relative to the base portion of the first front partial side panel, and the upper corner of the second generally rectangular panel is separated from the base portion of the second generally rectangular panel without independently folding the upper corner relative to the base portion of the second front partial side panel.

* * * * *